US009552765B2

(12) United States Patent
Lee et al.

(10) Patent No.: US 9,552,765 B2
(45) Date of Patent: Jan. 24, 2017

(54) PIXEL, PIXEL DRIVING METHOD, AND DISPLAY DEVICE INCLUDING THE PIXEL

(71) Applicant: SAMSUNG DISPLAY CO., LTD., Yongin, Gyeonggi-Do (KR)

(72) Inventors: Seung Woo Lee, Yongin (KR); Do Youb Kim, Yongin (KR); Tae Jin Kim, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 268 days.

(21) Appl. No.: 14/272,653

(22) Filed: May 8, 2014

(65) Prior Publication Data

US 2015/0049125 A1 Feb. 19, 2015

(30) Foreign Application Priority Data

Aug. 13, 2013 (KR) ..... 10-2013-0096044

(51) Int. Cl.
*G09G 3/3233* (2016.01)
*G09G 3/32* (2016.01)

(52) U.S. Cl.
CPC .... *G09G 3/3233* (2013.01); *G09G 2300/0804* (2013.01); *G09G 2300/0819* (2013.01); *G09G 2300/0852* (2013.01); *G09G 2300/0861* (2013.01)

(58) Field of Classification Search
CPC ..... G09G 3/30; G09G 2310/0289; G09G 2310/0272; G09G 3/32; G09G 3/3233
See application file for complete search history.

(56) References Cited

U.S. PATENT DOCUMENTS

2003/0107560 A1* 6/2003 Yumoto ..... G09G 3/30 345/204
2012/0105420 A1* 5/2012 Choi ..... G09G 3/3233 345/212

FOREIGN PATENT DOCUMENTS

| | | | |
|---|---|---|---|
| KR | 10-2005-0052033 | A | 6/2005 |
| KR | 10-0583519 | B1 | 5/2006 |
| KR | 10-2006-0064128 | A | 6/2006 |
| KR | 10-0600346 | B1 | 7/2006 |
| KR | 10-0649253 | B1 | 11/2006 |

* cited by examiner

*Primary Examiner* — Amare Mengistu
*Assistant Examiner* — Sarvesh J Nadkarni
(74) *Attorney, Agent, or Firm* — Lee & Morse, P.C.

(57) ABSTRACT

A pixel includes a switching transistor connected to a data line, a first circuit to control compensation of a first driving transistor, and a second circuit to control compensation of a second driving transistor. The first and second circuits are connected to the switching transistor. The first and second transistors are connected to respective organic light emitting diodes of a same pixel. Compensation of the first and second driving transistors is based on respective first and second subscan signals, which overlap periods of corresponding common scan signals to be received by the switching transistor.

19 Claims, 7 Drawing Sheets

PIXEL, PIXEL DRIVING METHOD, AND DISPLAY DEVICE INCLUDING THE PIXEL

CROSS-REFERENCE TO RELATED APPLICATION

Korean Patent Application No. 10-2013-0096044, filed on Aug. 13, 2013, in the Korean Intellectual Property Office, and entitled, "Pixel, Pixel Driving Method, and Display Device Including The Pixel," is incorporated by reference herein in its entirety.

BACKGROUND

1. Field

One or more embodiments described herein relate to a display device.

2. Description of the Related Art

A display device includes a plurality of pixels for display of an image. In one type of device, each pixel includes at least two subpixels driven by one driving circuit. In a time division driving method, the driving circuit drives a first one of the subpixels in a preceding subfield of a frame and a second one of the subpixels in another subfield of the frame. As a result, the first subpixel emits light in the preceding subfield and second subpixel emits light in the next subfield.

However, when a particular pattern is displayed according to the time division driving method, the time division method may be observed by a user. For example, one screen may be divided into multiple frames, which may impair image quality.

SUMMARY

In accordance with one embodiment, a pixel includes a switching transistor including a terminal connected to a data line, the switching transistor configured to perform a switching operation based on a first common scan signal; a first compensation transistor configured to perform a switching operation based on a first sub scan signal; a second compensation transistor configured to perform a switching operation based on a second sub scan signal; a first driving transistor including a source connected to another terminal of the switching transistor, the first driving transistor configured to control a first driving current based on a first data signal transmitted when the first compensation transistor and the switching transistor are turned on; a second driving transistor including a source connected to another terminal of the switching transistor, the second driving transistor configured to control a second driving current based on a second data signal transmitted when the second compensation transistor and the switching transistor are turned on; a first light emitting device configured to emit light based on the first driving current; and a second light emitting device configured to emit light based on the second driving current.

A first capacitor may be connected between a gate of the first driving transistor and a first power source voltage; and a second capacitor may be connected between a gate of the second driving transistor and the first power source voltage.

A first initialization transistor may be configured to transmit an initialization voltage to a first node connected to the gate of the first driving transistor and the first capacitor according to a second common scan signal. A second initialization transistor may be configured to transmit the initialization voltage to a second node connected to the gate of the second driving transistor and the second capacitor according to the second common scan signal. Each of the first common scan signal and the second common scan signal may include two enable pulses, and the two enable pulses of the first common scan signal may be applied or received before the two enable pulses of the second common scan signal.

The first common scan signal may include two enable pluses, an enable pulse of the first sub scan signal may overlap one of the two enable pulses of the first common scan signal, and an enable pulse of the second sub scan signal may overlap the other one of the two enable pulses of the first common scan signal. The first compensation transistor may be connected between a gate and a drain of the first driving transistor, and the second compensation transistor may be connected between a gate and a drain of the second driving transistor.

A first light emission transistor may be connected to sources of the first driving transistor and the second driving transistor and to a first power source voltage, wherein the first light emission transistor may be turned on after the first data signal and the second data signal are written in gates of the first and second driving transistors, respectively.

A second light emission transistor may be connected between a drain of the first driving transistor and the first light emitting device; and a third light emission transistor may be connected between a drain of the second driving transistor and the second light emitting device, wherein the second and third light emission transistors may be turned on after the first data signal and the second data signal are written in gates of the first and second driving transistors, respectively.

In accordance with another embodiment, a method of driving a pixel includes turning on a switching transistor based on a first common scan signal; turning on a first compensation transistor based on a first sub scan signal; transmitting a first data signal to a gate of a first driving transistor through the turned on switching transistor and first compensation transistor; turning on a second compensation transistor based on a second sub scan signal; and transmitting a second data signal to a gate of a second driving transistor through the turned on switching transistor and second compensation transistor, wherein a turn-on period of the switching transistor overlaps turn-on periods of the first and second compensation transistors and wherein the turn-on periods of the first and second compensation transistors are at different times.

The method may further include maintaining a voltage transmitted to the gate of the first driving transistor by a first capacitor based on the first data signal; and maintaining a voltage transmitted to the gate of the second driving transistor by a second capacitor based on the second data signal.

The method may further include transmitting an initialization voltage to a first node connected to the gate of the first driving transistor and the first capacitor according to a second common scan signal; and transmitting the initialization voltage to a second node connected to the gate of the second driving transistor and the second capacitor according to the second common scan signal. Transmitting the initialization voltage to the first node and the second node may be performed before the switching transistor, the first compensation transistor, and the second compensation transistor are turned on.

After the first data signal and the second data signal are written in the gates of the first and second driving transistors, respectively, the method may include controlling a first driving current to flow through the first driving transistor to cause a first light emitting device to emit light; and controlling a second driving current to flow through the second driving transistor to cause a second light emitting device to emit light.

In accordance with another embodiment, a display device includes a plurality of common scan lines, a plurality of first sub scan lines, a plurality of second sub scan lines, a plurality of light emission control lines, and a plurality of data lines; and a plurality of pixels, each pixel is connected to two corresponding common scan lines, a corresponding one of the first sub scan lines, a corresponding one of the second sub scan lines, a corresponding one of the light emission control lines, and a corresponding one of the data lines.

Each pixel includes a first light emitting device and a second light emitting device; a switching transistor including a first terminal connected to the corresponding data line and a gate connected to a first one of the two common scan lines; a first driving transistor including a source connected to a second terminal of the switching transistor, the first driving transistor configured to control a first driving current supplied to the first light emitting device; a second driving transistor including a source connected to the second terminal of the switching transistor, the second driving transistor configured to control a second driving current supplied to the second light emitting device; a first compensation transistor connected between a gate and a drain of the first driving transistor, the first compensation transistor including a gate connected to the corresponding first sub scan line; and a second compensation transistor connected between a gate and a drain of the second driving transistor, the second compensation transistor including a gate connected to the corresponding second sub scan line, and a first data signal is written in the gate of the first driving transistor and a second data signal is written in the gate of the second driving transistor, wherein the first data signal is transmitted when the first compensation transistor and the switching transistor are turned on and wherein the second data signal is transmitted when the second compensation transistor and the switching transistor are turned on.

The pixel may include a first capacitor connected between the gate of the first driving transistor and a first power source voltage; and a second capacitor connected between the gate of the second driving transistor and the first power source voltage.

The pixel may include a first initialization transistor including one terminal connected to an initialization voltage, another terminal connected to a first node connected to the gate of the first driving transistor and the first capacitor, and a gate connected to a second common scan line among the two corresponding common scan lines; and a second initialization transistor including one terminal connected to the initialization voltage, another terminal connected to a second node connected to the gate of the second driving transistor and the second capacitor, and a gate connected to the second common scan line.

Each of a first common scan signal transmitted through the first common scan line and a second common scan signal transmitted through the second common scan line may include two enable pulses, and the two enable pulses of the second common scan signal may be before the two enable pulses of the first common scan signal.

A first common scan signal may be transmitted through the first common scan line includes two enable pulses, an enable pulse of a first sub scan signal transmitted through the first sub scan line may overlap one of two enable pulses of the first common scan signal, and an enable pulse of a second sub scan signal transmitted through the second sub scan line may overlap the other one of the two enable pulses of the first common scan signal.

The pixel may include a first light emission transistor connected between sources of each of the first and second driving transistors and a first power source voltage, and the first light emission transistor is turned on after the first data signal and the second data signal is written in gates of the first and second driving transistors, respectively.

The pixel may include a second light emission transistor connected between a drain of the first driving transistor and the first light emitting device; and a third light emission transistor connected between a drain of the second driving transistor and the second light emitting device, and the second and third light emission transistors are turned on after the first data signal and the second data signal are written in the gates of the first and second driving transistors, respectively.

In accordance with another embodiment, a pixel includes a switching transistor connected to a data line; a first circuit to control compensation of a first driving transistor; and a second circuit to control compensation of a second driving transistor, wherein the first and second circuits are connected to the switching transistor, the first and second transistors are connected to respective organic light emitting diodes of a same pixel, and compensation of the first and second driving transistors is based on respective first and second subscan signals which overlap periods of corresponding common scan signals to be received by the switching transistor.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
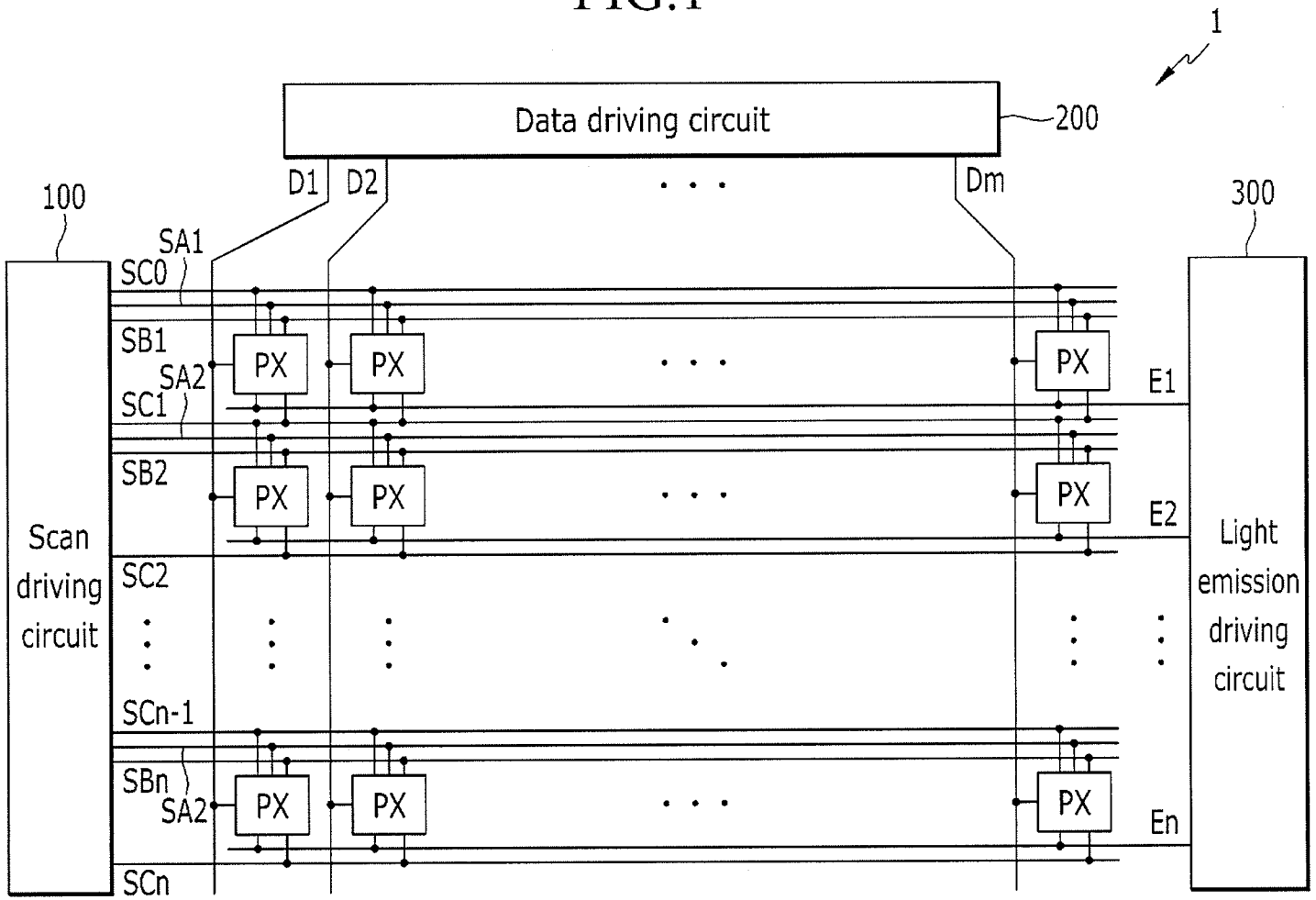
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawing figures, the dimensions of layers and regions may be exaggerated for clarity of illustration. Like reference numerals refer to like elements throughout.

FIG. 1 illustrates an embodiment of display device 1 which includes a scan driving circuit 100, a data driving circuit 200, a light emission driving circuit 300, a plurality of common scan lines SC1-SCn, a plurality of sub scan lines SA1-SAn and SB1-SBn, a plurality of light emission control lines E1-En, a plurality of data lines D1-Dm, and a plurality of pixels PX.

The common scan lines SC1-SCn and sub scan lines SA1-SAn and SB1-SBn are vertically arranged and extend horizontally. Similarly, the light emission control lines E1-En extend horizontally and are vertically arranged. The data lines D1-Dm extend vertically and are horizontally arranged. Each pixel PX is connected to two of the common scan lines, one of the sub scan lines sub scan lines SA1-SAn and one of the sub scan lines SB1-SBn, one of the light emission control lines, and one of the data lines.

The scan driving circuit 100 supplies common scan signals SC[1]-SC[n] and sub scan signals SA[1]-SA[n] and SB[1]-SB[n] to respective ones of the common scan lines SC1-SCn and sub scan lines SA1-SAn and SB1-SBn. The light emission driving circuit 300 supplies light emission signals EM[1]-EM[n] to respective ones of the light emission control lines E1-En. The data driving circuit 200 generates data signals (for example, data voltages) according to input image data signal DAT and supplies the data signals to respective ones of the data lines D1-Dm.

Each of the pixels PX is initialized according to a scan signal supplied through one of two corresponding common scan lines and synchronized with a scan signal supplied through the other of the two corresponding common scan line. Each of the pixels PX receives two data signals from a corresponding one of the data lines. One of the two data signals is written in the pixel PX according to a sub scan signal supplied through one of two corresponding sub scan lines. The other one of the two data signals is written in pixel PX according to a sub scan signal supplied through the other one of the two corresponding sub scan lines. Two driving currents that correspond to the data signals written in each pixel PX are supplied to organic light emitting diodes of the pixel PX based on corresponding light emission signals.

Although pixel PX has been described as including two subpixels (or two light emitting devices), a different number of subpixels may be included in other embodiments. The number of sub scan signals may be determined by the number of subpixels (or the number of light emitting devices) in the pixel PX. The number of pulses of the common scan signal may be determined based on the number of subpixels.

Figure 2:
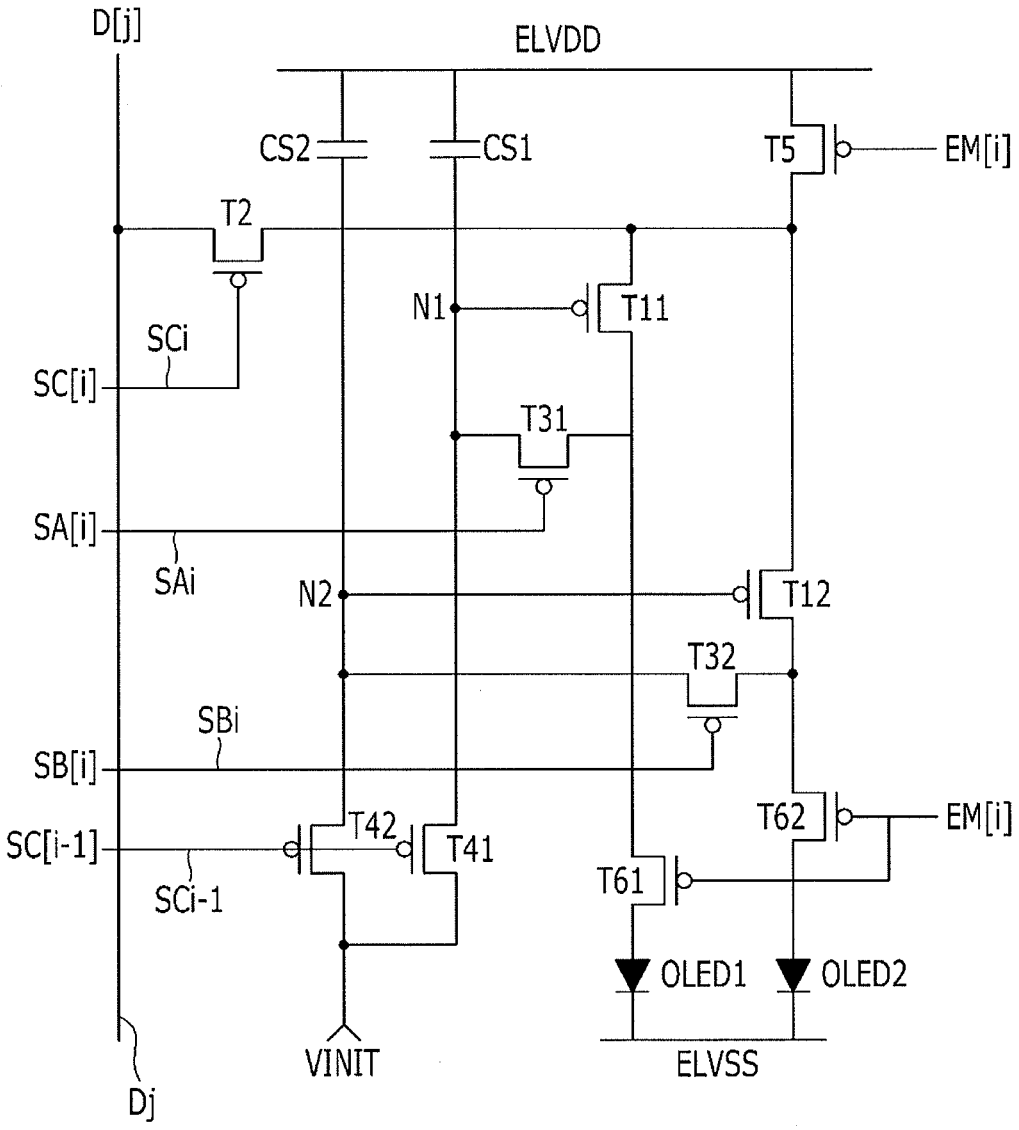
FIG. 2 illustrates an embodiment of a pixel.

FIG. 2 illustrates an embodiment of a pixel which, for example, may be included in a display device as illustrated in FIG. 1. For illustrative purposes, FIG. 2 illustrates a pixel PX connected to an (i−1)-th common scan lines, an i-th common scan line, i-th two sub scan lines, an i-th light emission control line, and a j-th data line. Other pixels PX in the display device may be similarly configured.

As illustrated in FIG. 2, pixel PX includes two driving transistors T11 and T12, a switching transistor T2, two compensation transistors T31 and T32, two initialization transistors T41 and T42, three light emission transistors T5, T61, and T62, two capacitors CS1 and CS2, and two light emitting devices in the form of organic light emitting diodes OLED1 and OLED2. Power source voltages ELVDD and ELVSS are set to be at levels for operating pixel PX. For example, power source voltage ELVDD may be higher than power source voltage ELVSS, and a difference between the voltages may be set to be at least higher than a predetermined level required for operating the pixel PX. An initialization voltage VINIT may be set to a voltage having a level for initializing the pixel PX.

The switching transistor T2 has one terminal connected to data line Dj and another terminal connected to sources of driving transistors T11 and T12, and a gate connected to a common scan line SCi.

The initialization transistor T41 has one terminal connected to initialization voltage VINT, a gate connected to common scan line SCi−1, and another terminal connected to a node N1. The initialization transistor T42 has one terminal connected to initialization voltage VINT, the gate connected to common scan line SCi−1, and another terminal connected to a node N2.

The compensation transistor T31 has terminals connected between the gate (node N1) and the drain of driving transistor T11, and a gate connected to sub scan line SAi. The compensation transistor T32 has terminals connected between the gate (node N2) and drain of driving transistor T12, and a gate connected to sub scan line SBi.

The light emission transistor T5 has one terminal connected to the source of driving transistor T11, another terminal connected to power source voltage ELVDD, and a gate connected to light emission control line EMi. The light emission transistor T61 has one terminal connected to the drain of driving transistor T11, another terminal connected to an anode of the organic light emitting diode OLED1, and a gate connected to light emission control line EMi. The light emission transistor T62 includes one terminal connected to the drain of driving transistor T12, another terminal connected to an anode of the organic light emitting diode OLED2, and a gate connected to the light emission control line EMi.

The driving transistor T11 includes a source connected to one terminal of switching transistor T2 and a terminal of light emission transistor T5, a drain connected to a terminal of compensation transistor T31 and a terminal of light emission transistor T61, and a gate connected to node N1.

The driving transistor T12 includes a source connected to a the other end of the switching transistor T2 and the one end of the light emission transistor T5, a drain connected to one terminal of compensation transistor T32 and one terminal of light emission transistor T62, and a gate connected to node N2.

The capacitor CS1 is connected between node N1 and power source voltage ELVDD, and a cathode of the organic light emitting diode OLED1 is connected to power source voltage ELVSS. The capacitor CS2 is connected between node N2 and power source voltage ELVDD, and a cathode of the organic light emitting diode OLED2 is connected to power source voltage ELVSS.

The common scan signal SC[i−1] is transmitted through common scan line SCi−1, common scan signal SC[i] is transmitted through common scan line SCi, sub scan signal SA[i] is transmitted through the sub scan line SAi, sub scan signal SB[i] is transmitted through sub scan line SBi, light emission signal EM[i] is transmitted through light emission control line Emi, and data signal D[j] is transmitted through data line Dj.

Figure 3:
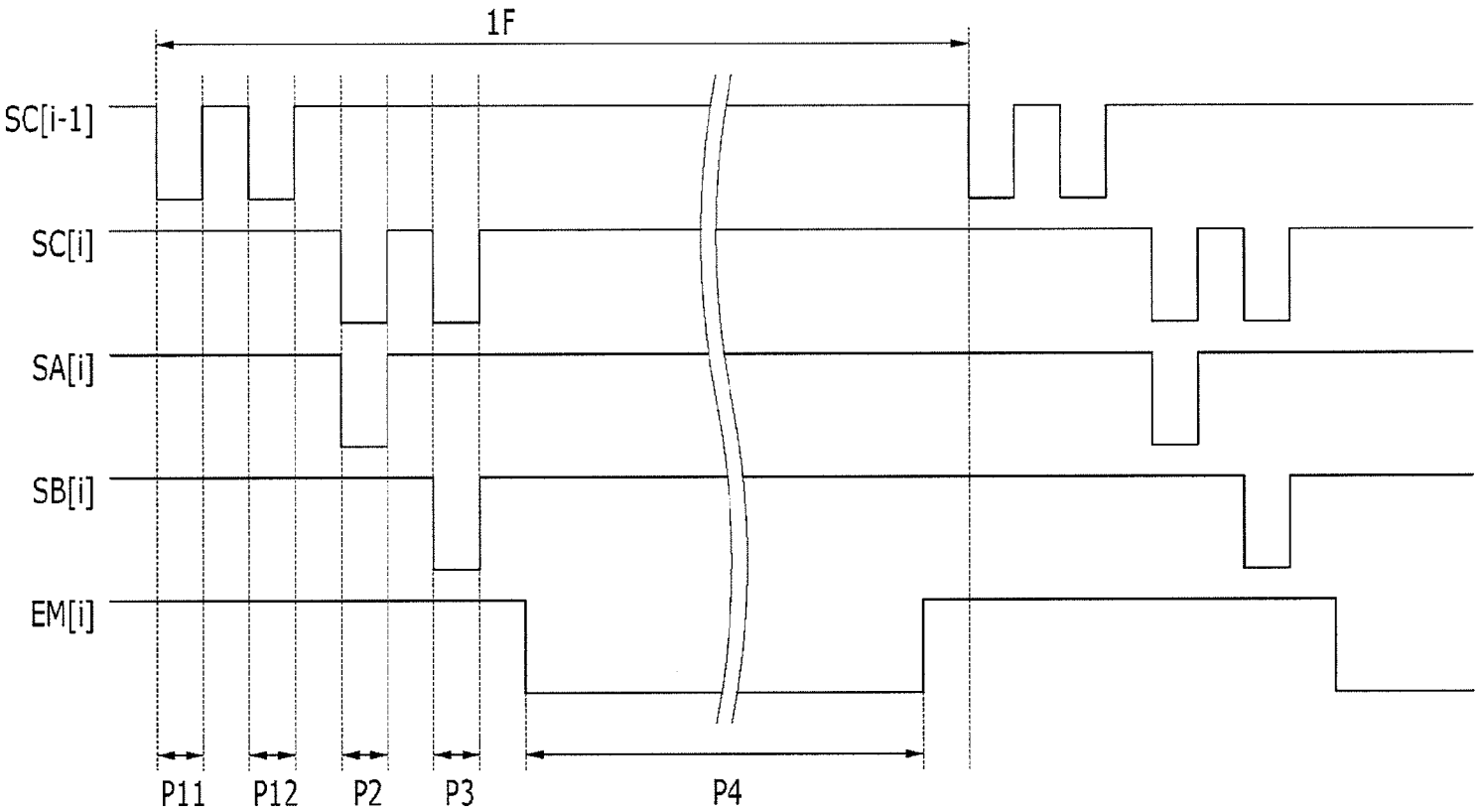
FIG. 3 illustrates an embodiment of a waveform for driving the pixel.

FIG. 3 illustrates an embodiment of a waveform for operating the pixel in FIG. 2. The waveform includes a common scan signal, sub scan signal, and light emission signal for a predetermined period including one frame period 1F. More specifically, FIG. 3 illustrates a common scan signal SC[i−l], a common scan signal SC[i], a sub scan signal SA[i], a sub scan signal SB[i], and a light emission signal EM[i].

Each of the common sub scan signals includes two enable pulses which may be sequentially generated. In FIG. 3, two common scan signals SC[i−1] and SC[i] which are temporally adjacent to each other are illustrated. An enable level is shown to be a low level in order to be compatible with a p-channel type switching transistor. In other embodiments, the enable level may be a high level, for example, in the case where the switching transistor is an n-channel type.

The sub scan signal SA[i] is synchronized with the first one of the two enable pulses of common scan signal SC[i]. The sub scan signal SB[i] is synchronized with the second one of the two enable pulses of the common scan signal SC[i].

The light emission signal EM[i] is disabled for a predetermined period, including a period during which common scan signals SC[i−1] and SC[i] and sub scan signals SA[i] and SB[i] are enabled. The light emission signal EM[i] is enabled after the predetermined period, including the period during which common scan signals SC[i−1] and SC[i] and sub scan signals SA[i] and SB[i] are disabled.

Because light emission transistors T5, T61, and T62 are p-channel type transistors, an enable level of the light emission signal is a low level and a disable level of the light emission signal is a high level. Also, the enable pulses of the common scan signal and sub scan signal are illustrated to have the same width. In other embodiments, these enable pulses may have different widths.

A first enable pulse of the common sub scan signal SC[i] and an enable pulse of sub scan signal SA[i] may temporally overlap in a same period. That is, the period in which two enable pulses overlap each other has only to be generated. The overlap may be complete or partial. Similarly, a second enable pulse of common sub scan signal SC[i] and an enable pulse of sub scan signal SB[i] may temporally overlap in a same period in FIG. 3. That is, a period in which two enable pulses overlap each other has only to be generated. The overlap may be complete or partial.

Figure 4:
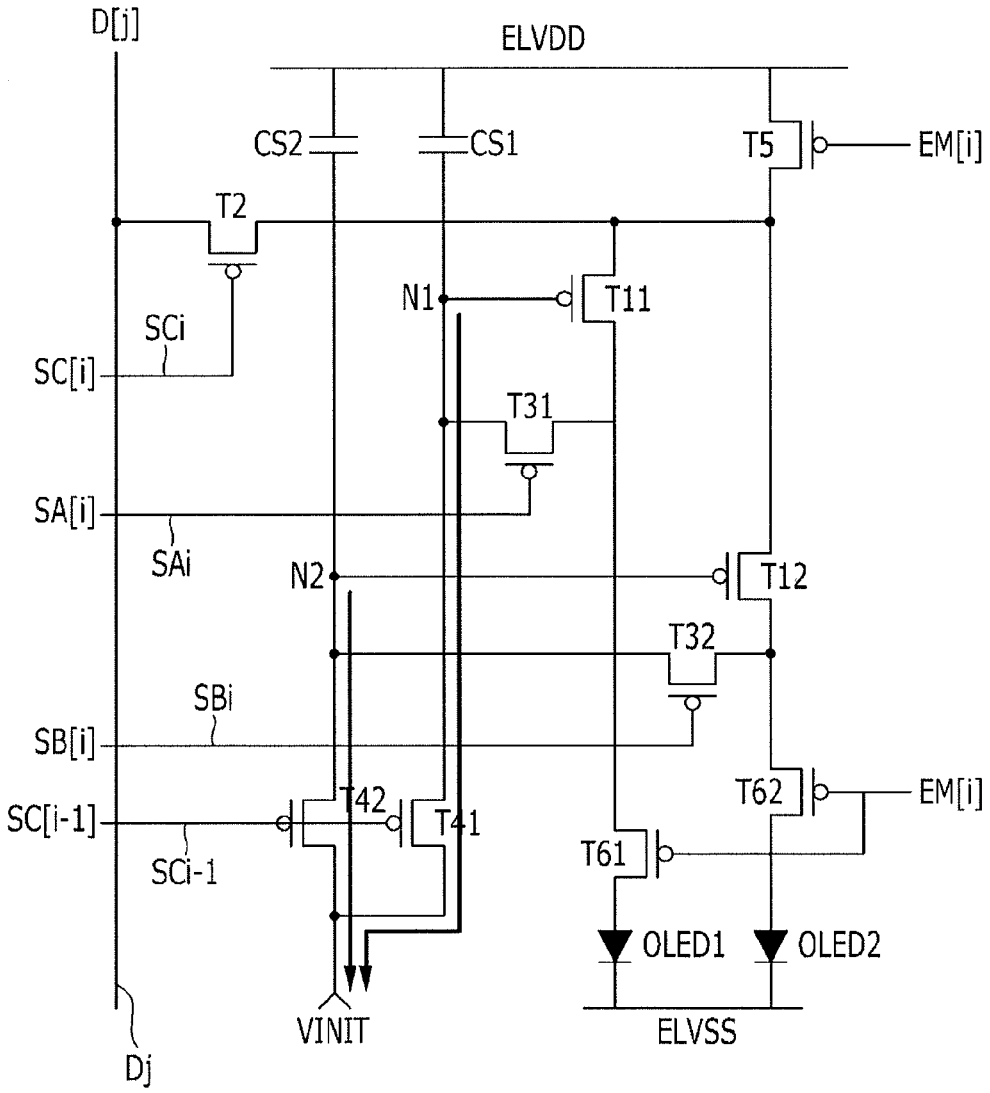
FIG. 4 illustrates an operation of a pixel for an initialization period.

FIG. 4 illustrates operation of the pixel for an initialization period in FIG. 3. For periods P11 and P12, initialization transistors T41 and T42 are turned on by an enable pulse of common scan signal SC[n−1]. The periods may be referred to as initialization periods. When initialization transistors T41 and T42 are turned on, node N1 and node N2 are connected to initialization voltage VINIT through respective signal paths, to thereby initialize nodes N1 and node N2. Thus, voltages charged to capacitors CS1 and CS2 are initialized, and gate voltages of driving transistors T11 and T12 are initialized.

Figure 5:
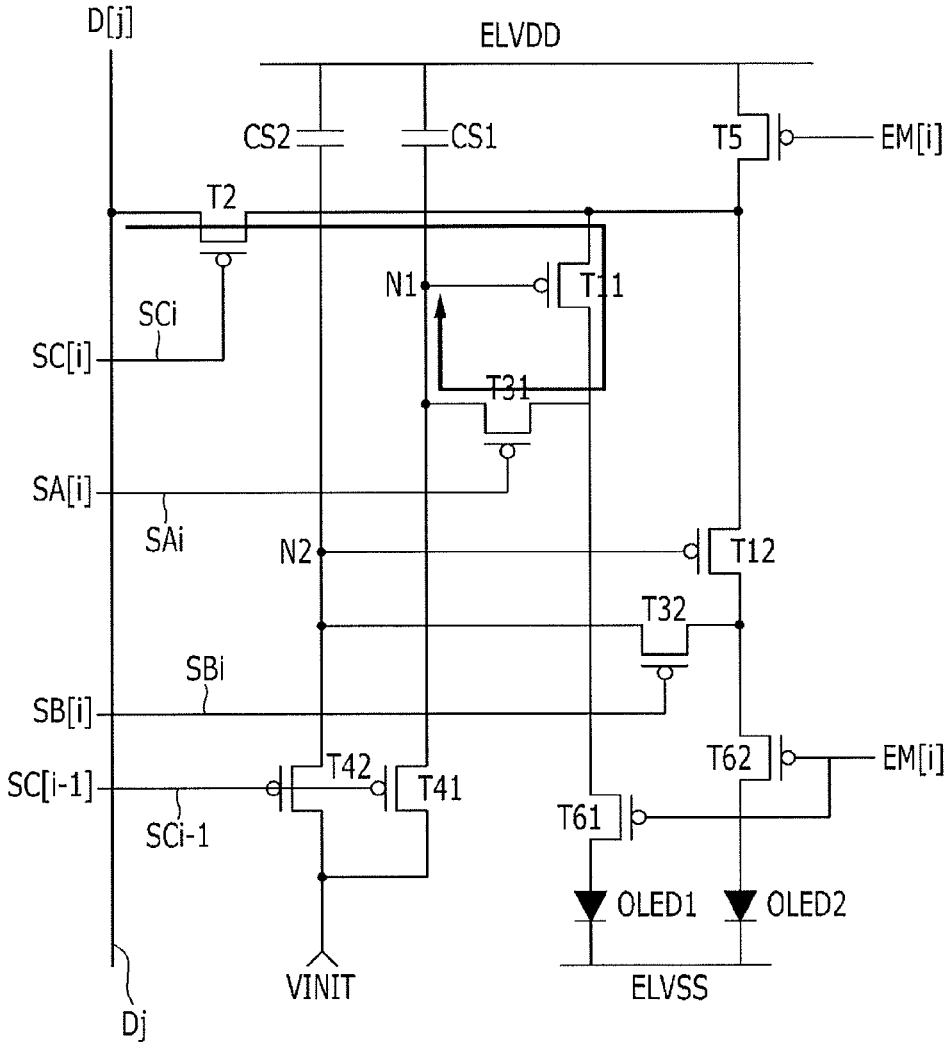
FIG. 5 illustrates an operation of a pixel for a first scan period.

FIG. 5 illustrates an operation of the pixel for a first scan period in FIG. 3. The switching transistor T2 is turned on by the enable pulse of common scan signal SC[n], and compensation transistor T31 is turned on by the enable pulse of sub scan signal SA[n] for period P2. The period P2 may be referred to as the first scan period.

When switching transistor T2 and compensation transistor T31 are turned on, a path between data line Dj and node N1 is formed to allow data signal D[j] to be written in node N1. A gate and drain of driving transistor T11 are connected to each other by compensation transistor T31, and the driving transistor T11 is diode-connected. When a voltage of data signal D[j] for the first scan period is Vdata1, a voltage "Vdata1+Vth1" generated by adding a threshold voltage Vth1 of driving transistor T11 from voltage Vdata1 is applied to node N1. Since driving transistor T11 is a p-channel type transistor, the threshold voltage Vth1 is a negative voltage. The voltage written in the node N1 is maintained by the capacitor CS1.

Figure 6:
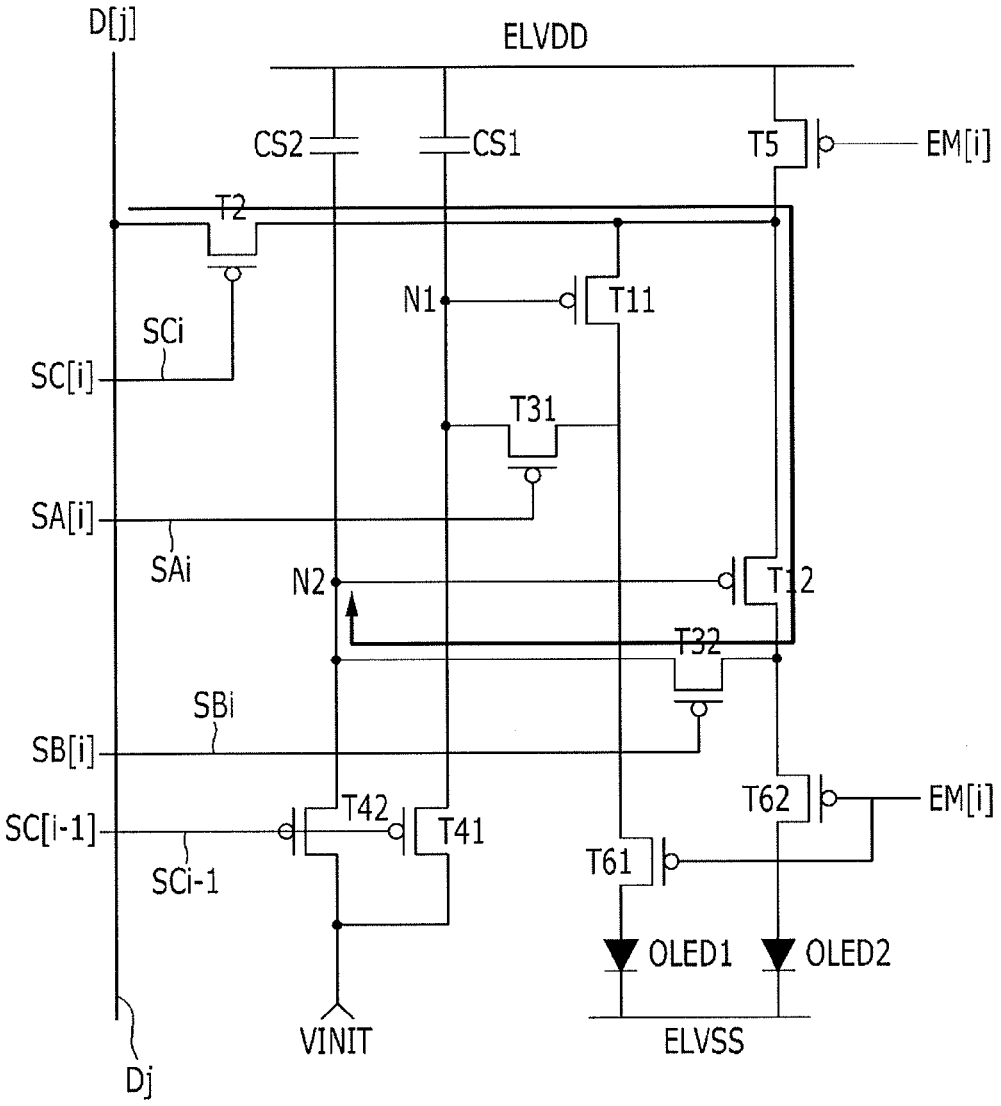
FIG. 6 illustrates an operation of a pixel for a second scan period.

FIG. 6 illustrates an operation of the pixel for a second scan period in FIG. 3. Switching transistor T2 is turned on by the enable pulse of common scan signal SC[n], and compensation transistor T32 is turned on by the enable pulse of sub scan signal SB[n] for period P3. The period P3 may be referred to as the second scan period.

When switching transistor T2 and compensation transistor T32 are turned on, a path between data line Dj and node N2 is formed, to thereby allow data signal D[j] to be written in node N2. A gate and drain of driving transistor T12 are connected to each other by compensation transistor T32, and the driving transistor T12 is diode-connected. When a voltage of data signal D[j] for the second scan period is Vdata1, a voltage "Vdata2+Vth2" generated by adding a threshold voltage of Vth2 of driving transistor T12 from voltage Vdata2 is applied to node N2. Since the driving transistor T12 is a p-channel type transistor, the threshold voltage Vth2 is a negative voltage. The voltage written in node N2 is maintained by capacitor CS2.

Figure 7:
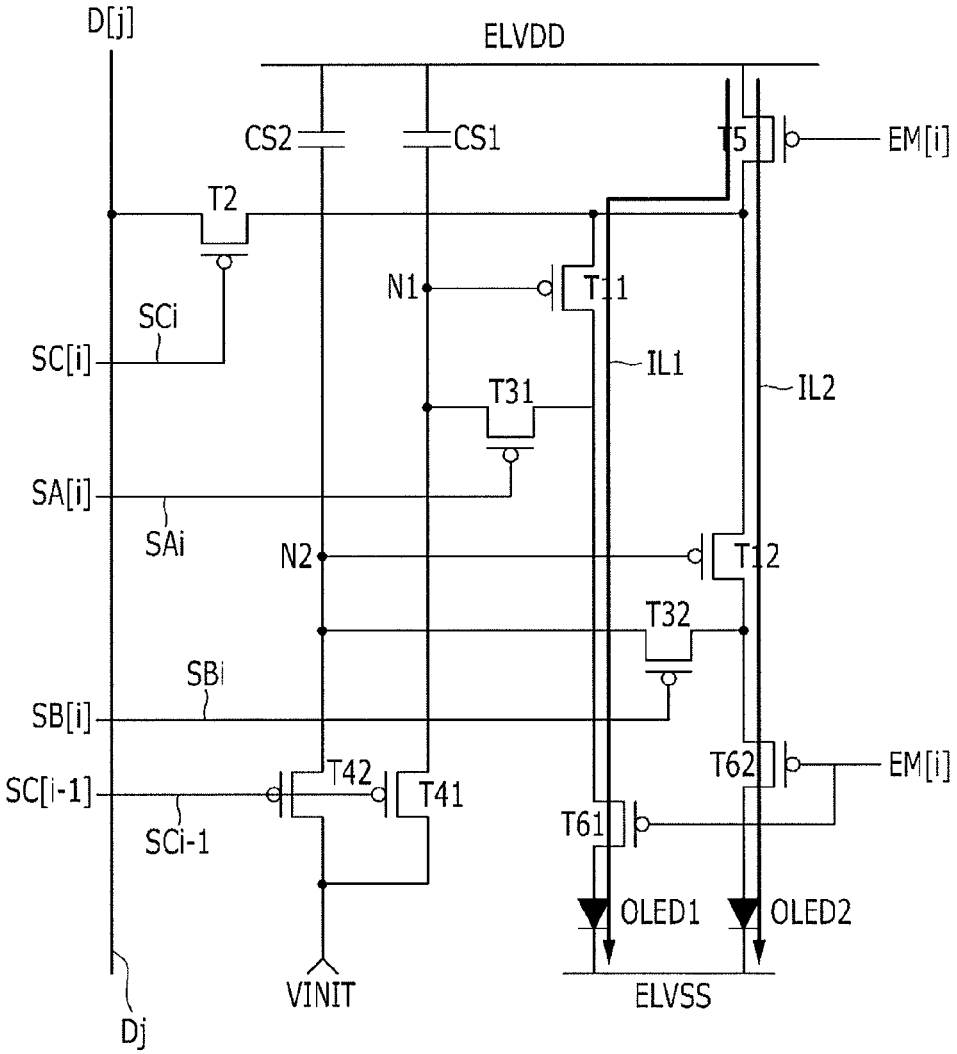
FIG. 7 illustrates an operation of a pixel for a light emission period.

FIG. 7 illustrates operation of the pixel for a light emission period in FIG. 3. For a period P4, light emission transistors T5, T61, and T62 are turned on. Accordingly, a path is formed between power source voltages ELVDD and ELVSS, and driving currents IL1 and IL2 flow through corresponding paths.

The driving current IL1 is determined by voltage Vdata1+Vth1 written in the gate of driving transistor T11 for the first scan period P2, and driving current IL2 is determined by voltage Vdata2+Vth2 written in the gate of driving transistor T12 for the second scan period P3. Driving currents IL1 and IL2 may be determined based on Equation 1.

$$I=\beta/2*(Vgs-Vth)^2 \quad (1)$$

In Equation 1, I denotes a current flowing between the drain and source of the driving transistor (that is, a driving current), β denotes a constant determined according to a parameter of the driving transistor and a size of the driving transistor, Vgs denotes a gate-source voltage of the driving transistor, and Vth denotes a threshold voltage of the driving transistor. The constant β of driving transistor T11 and β of driving transistor T12 may be determined to be the same in at least one embodiment.

Further, when the voltage written in each of nodes N1 and node N2 is put into Equation 1, driving current IL1 is β/2*(ELVDD-Vdata1)^2 and the driving current IL2 is β/2*(ELVDD-Vdata2)^2. That is, the organic light emitting diode OLED1 emits light based on driving current IL1 and organic light emitting diode OLED2 emits light based on driving current IL2 for light emission period P4.

According to an example embodiment, even when one driving circuit drives two subpixels (two light emitting devices), one frame is not divided into two subfields. Then, for example, a display device can be driven according to a sequential driving method. Moreover, it may be possible to prevent picture quality deterioration (for example, a problem in which divided subfields are recognized by a user) generated when a time division driving scheme is performed in which one frame is divided into a plurality of subfields.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel comprising:

a switching transistor including a terminal connected to a data line, the switching transistor to perform a switching operation based on a first common scan signal;

a first compensation transistor to perform a switching operation based on a first sub scan signal;

a second compensation transistor to perform a switching operation based on a second sub scan signal;

a first driving transistor including a source connected to another terminal of the switching transistor, the first driving transistor to control a first driving current based on a first data signal transmitted when the first compensation transistor and the switching transistor are turned on;

a second driving transistor including a source connected to the other terminal of the switching transistor, the second driving transistor to control a second driving current based on a second data signal transmitted when the second compensation transistor and the switching transistor are turned on;

a first light emitting device figured to emit light based on the first driving current; and a second light emitting device to emit light based on the second driving current, wherein:

the first common scan signal includes two enable pulses during one frame period, an enable pulse of the first sub scan signal overlaps one of the two enable pulses of the first common scan signal, and an enable pulse of the second sub scan signal overlaps the other one of the two enable pulses of the first common scan signal.

2. The pixel as claimed in claim 1, further comprising:

a first capacitor connected between a gate of the first driving transistor and a first power source voltage; and a second capacitor connected between a gate of the second driving transistor and the first power source voltage.

3. The pixel as claimed in claim 2, further comprising:

a first initialization transistor configured to transmit an initialization voltage to a first node connected to the gate of the first driving transistor and the first capacitor according to a second common scan signal; and a second initialization transistor configured to transmit the initialization voltage to a second node connected to the gate of the second driving transistor and the second capacitor according to the second common scan signal.

4. The pixel as claimed in claim 3, wherein:

each of the first common scan signal and the second common scan signal includes two enable pulses, and the two enable pulses of the first common scan signal are before the two enable pulses of the second common scan signal.

5. The pixel as claimed in claim 1, wherein:

the first compensation transistor is connected between a gate and a drain of the first driving transistor, and the second compensation transistor is connected between a gate and a drain of the second driving transistor.

6. The pixel as claimed in claim 1, further comprising:

a first light emission transistor connected to sources of the first driving transistor and the second driving transistor and to a first power source voltage, wherein the first light emission transistor is turned on after the first data signal and the second data signal are written in gates of the first and second driving transistors, respectively.

7. The pixel as claimed in claim 1, further comprising:

a second light emission transistor connected between a drain of the first driving transistor and the first light emitting device; and a third light emission transistor connected between a drain of the second driving transistor and the second light emitting device, wherein the second and third light emission transistors are turned on after the first data signal and the second data signal are written in gates of the first and second driving transistors, respectively.

8. A method of driving a pixel, the method comprising:

turning on a switching transistor based on one of two enable pulses of a first common scan signal;

turning on a first compensation transistor based on a first sub scan signal;

transmitting a first data signal to a gate of a first driving transistor through the turned on switching transistor and first compensation transistor;

turning on the switching transistor based on the other one of the two enable pulses of the first common scan signal;

turning on a second compensation transistor based on a second sub scan signal; and transmitting a second data signal to a gate of a second driving transistor through the turned on switching transistor and second compensation transistor, wherein a turn-on period of the switching transistor overlaps turn-on periods of the first and second compensation transistors and wherein the turn-on periods of the first and second compensation transistors are at different times.

9. The method as claimed in claim 8, further comprising:

maintaining a voltage transmitted to the gate of the first driving transistor by a first capacitor based on the first data signal; and maintaining a voltage transmitted to the gate of the second driving transistor by a second capacitor based on the second data signal.

10. The method as claimed in claim 9, further comprising:

transmitting an initialization voltage to a first node connected to the gate of the first driving transistor and the first capacitor according to a second common scan signal; and transmitting the initialization voltage to a second node connected to the gate of the second driving transistor and the second capacitor according to the second common scan signal.

11. The method as claimed in claim 10, wherein transmitting the initialization voltage to the first node and the second node is performed before the switching transistor, the first compensation transistor, and the second compensation transistor are turned on.

12. The method as claimed in claim 8, wherein, after the first data signal and the second data signal are written in the gates of the first and second driving transistors, respectively, the method includes:

controlling a first driving current to flow through the first driving transistor to cause a first light emitting device to emit light; and controlling a second driving current to flow through the second driving transistor to cause a second light emitting device to emit light.

13. A display device, comprising:

a plurality of common scan lines, a plurality of first sub scan lines, a plurality of second sub scan lines, a plurality of light emission control lines, and a plurality of data lines; and a plurality of pixels, each pixel is connected to two corresponding common scan lines, a corresponding one of the first sub scan lines, a corresponding one of the second sub scan lines, a corresponding one of the light emission control lines, and a corresponding one of the data lines, and wherein each pixel includes:

a first light emitting device and a second light emitting device;

a switching transistor including a first terminal connected to the corresponding data line and a gate connected to a first one of the two common scan lines;

a first driving transistor including a source connected to a second terminal of the switching transistor, the first driving transistor configured to control a first driving current supplied to the first light emitting device;

a second driving transistor including a source connected to the second terminal of the switching transistor, the second driving transistor configured to control a second driving current supplied to the second light emitting device;

a first compensation transistor connected between a gate and a drain of the first driving transistor, the first compensation transistor including a gate connected to the corresponding first sub scan line; and a second compensation transistor connected between a gate and a drain of the second driving transistor, the second compensation transistor including a gate connected to the corresponding second sub scan line, wherein a first data signal is written in the gate of the first driving transistor and a second data signal is written in the gate of the second driving transistor, the first data signal being transmitted when the first compensation transistor and the switching transistor are turned on, and the second data signal being transmitted when the second compensation transistor and the switching transistor are turned on, wherein each of a first common scan signal transmitted through the first common scan line and a second common scan signal transmitted through the second common scan line includes two enable pulses during one frame period, and the two enable pulses of the second common scan signal are before the two enable pulses of the first common scan signal.

14. The display device as claimed in claim 13, wherein each pixel includes:

a first capacitor connected between the gate of the first driving transistor and a first power source voltage; and a second capacitor connected between the gate of the second driving transistor and the first power source voltage.

15. The display device as claimed in claim 14, wherein each pixel includes:

a first initialization transistor including one terminal connected to an initialization voltage, another terminal connected to a first node connected to the gate of the first driving transistor and the first capacitor, and a gate connected to a second common scan line among the two corresponding common scan lines; and a second initialization transistor including one terminal connected to the initialization voltage, another terminal connected to a second node connected to the gate of the second driving transistor and the second capacitor, and a gate connected to the second common scan line.

16. The display device as claimed in claim 15, wherein:

each of a first common scan signal transmitted through the first common scan line and a second common scan signal transmitted through the second common scan line includes two enable pulses, and the two enable pulses of the second common scan signal are before the two enable pulses of the first common scan signal.

17. The display device as claimed in claim 13, wherein:

a first common scan signal transmitted through the first common scan line includes two enable pulses, an enable pulse of a first sub scan signal transmitted through the first sub scan line overlaps one of two enable pulses of the first common scan signal, and an enable pulse of a second sub scan signal transmitted through the second sub scan line overlaps the other one of the two enable pulses of the first common scan signal.

18. The display device as claimed in claim 13, wherein each pixel includes:

a first light emission transistor connected between sources of each of the first and second driving transistors and a first power source voltage, and the first light emission transistor is turned on after the first data signal and the second data signal is written in gates of the first and second driving transistors, respectively.

19. The display device as claimed in claim 13, wherein the pixel includes:

a second light emission transistor connected between a drain of the first driving transistor and the first light emitting device; and a third light emission transistor connected between a drain of the second driving transistor and the second light emitting device, and the second and third light emission transistors are turned on after the first data signal and the second data signal are written in the gates of the first and second driving transistors, respectively.

* * * * *